United States Patent [19]

Chung

[11] Patent Number: 4,956,917

[45] Date of Patent: Sep. 18, 1990

[54] STRUCTURE OF SPOON

[76] Inventor: Chin-Fu Chung, No. 18, Hsin Hsing Rd., Tainan, Taiwan

[21] Appl. No.: 466,817

[22] Filed: Jan. 18, 1990

[51] Int. Cl.[5] ..... A47J 43/28; A47J 47/00

[52] U.S. Cl. ..... 30/326; 30/324

[58] Field of Search ..... 30/326, 340, 324, 149, 30/147, 142, 125, 124, 123, DIG. 54; D10/46.2

[56] References Cited

U.S. PATENT DOCUMENTS

| | | | |
|---|---|---|---|
| D. 275,063 | 8/1984 | Greene | D10/46.2 |
| 1,521,656 | 1/1925 | Simpson | 30/326 |
| 3,287,806 | 11/1966 | Kellerman | 30/326 |
| 3,618,751 | 11/1971 | Rich | 30/326 |

*Primary Examiner*—Douglas D. Watts
*Assistant Examiner*—Paul M. Heyrana, Sr.
*Attorney, Agent, or Firm*—Varndell Legal Group

[57] ABSTRACT

A spoon, which comprises a sheet of plastic bags received in a bottom cap which is secured to the body thereof. Plastic bags can be drawn out of the bottom cap one by one, for wrapping up the spoon therein. A retainer ring is provided to sleeve on the handle of the spoon so as to secure a plastic bag to the spoon. Every plastic bag can be removed from the spoon each time after use, so that a new plastic bag can be used to wrap the spoon and the spoon can be repeatedly used without the need to wash.

1 Claim, 4 Drawing Sheets

STRUCTURE OF SPOON

BACKGROUND OF THE INVENTION

The present invention relates to spoons and more particularly to a spoon which can be repeatedly used without the need to wash.

Conventional disposable dinner set is generally made of foamed plastics, which are to be thrown away each time after use. However, the use of foamed plastics may cause environmental pollution because regular foamed plastics are not dissolvable in the weather. Further, foamed plastics may be easily blown to turn over by wind force and may produce chemical reaction when it is used to contain hot fluid. During chemical reaction, harmful substances may produce simultaneously. Therefore, it is harmful to people's health to use such kind of disposable products for containing foods.

An object of the present invention is to provide a spoon which can be repeatedly used without the need to wash.

Another object of the present invention is to provide a spoon in which the cover layers are made of a kind of plastic material which does not cause chemical reaction when it is heated by hot fluid.

Still another object of the present invention is to provide a spoon which does not produce environmental pollution.

Still another object of the present invention is to provide a spoon which is not easy to break or be blown by wind force to turn over.

A yet further object of the present invention is to provide a spoon which is inexpensive to manufacture.

The present invention will now be described by way of example, with reference to the annexed drawings, in which:

DETAILED DESCRIPTION OF THE PREFERRED EMBODIMENTS

Figure 1:
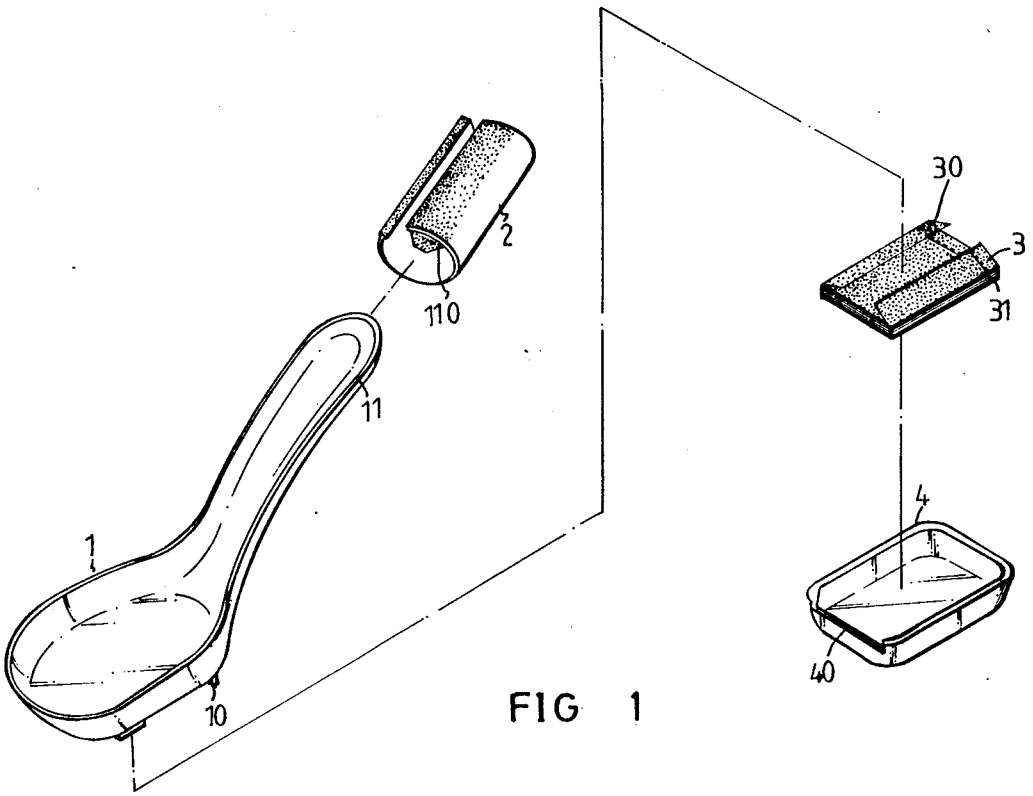
FIG. 1 is a fragmentary perspective view of a spoon according to the present invention.
Figure 3:
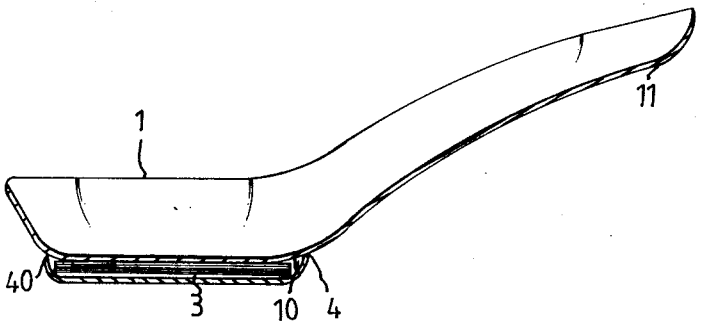
FIG. 3 is a sectional elevation of a spoon according to the present invention.
Figure 2:
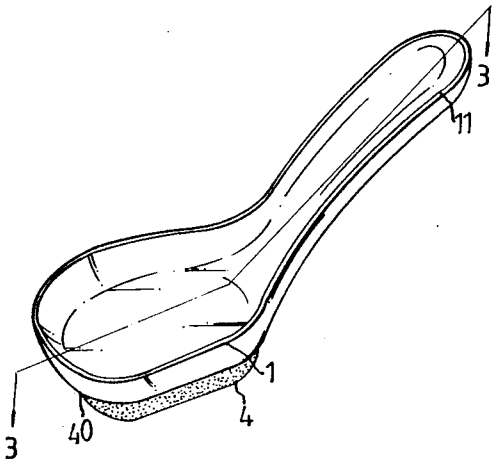
FIG. 2 is a perspective assembly view of a spoon according to the present invention.

Referring to FIGS. 1 through 3, a spoon in accordance with the present invention includes a body 1, a retainer ring 2, a sheet of plastic bags 3, and a bottom cap 4. As illustrated, the body 1 is a small, shadow, oval-shaped bowl 1 having an unitary handle 11 obliquely extending upward therefrom, and comprising a retainer member 10 on its bottom for securing the bottom cap 4 when the bottom cap 4 is mounted thereon. The retainer ring 2 comprises an inner projection 110 which can be inserted in the handle 11 of the body 1 when the retainer ring 2 is mounted thereon. The sheet of plastic bags 3 is folded up in a pile and received in the bottom cap 4 before the bottom cap 4 is secured to the body 1. The bottom cap 4 comprises a notch 40 one its one side so that the sheet of plastic bags 3 can be drawn out therethrough bag by bag after it is secured to the retainer member 10 of the body 1. The sheet of plastic bags 3 is comprised of a plurality of plastic bags 3 each being respectively defined by a sealing line 31 and an indentation line 30. When the sheet of plastic bags 3 is pulled out, an independent plastic bag can be easily separated from the sheet of plastic bags 3 through an indentation line 30.

Figure 5:
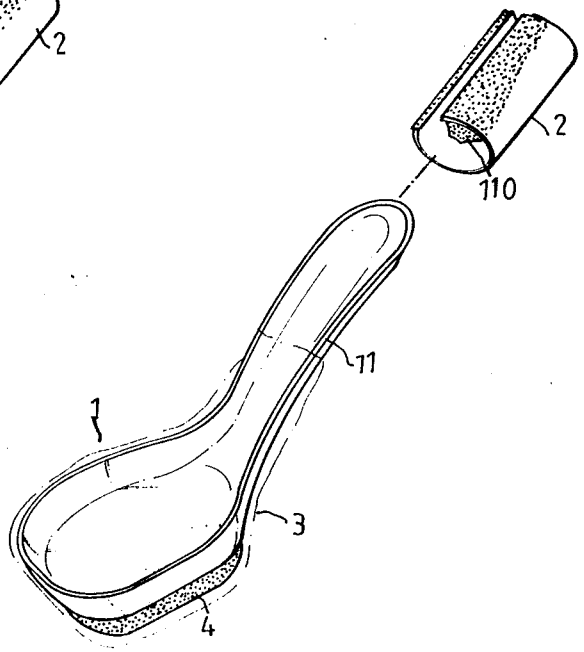
FIGS. 4 through 6 illustrate the use of the present invention.
Figure 4:
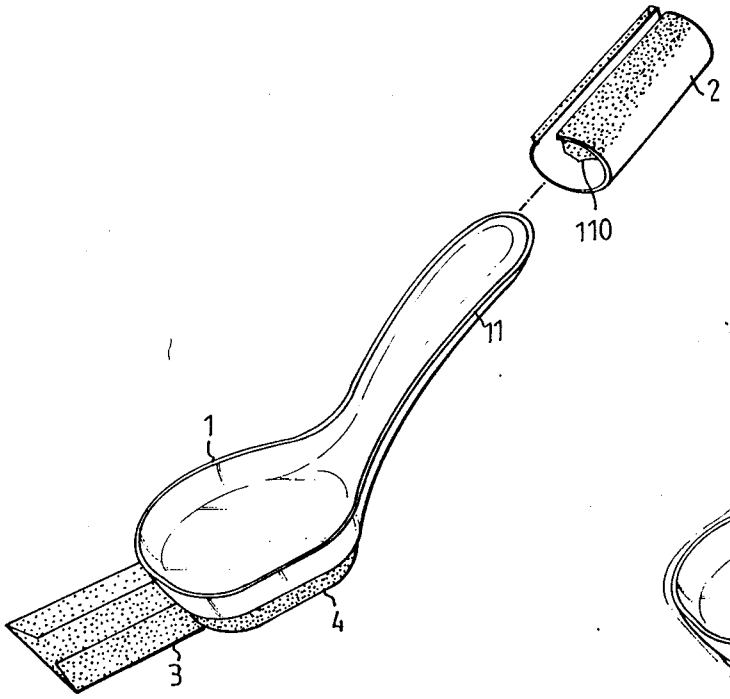
Figure 7:
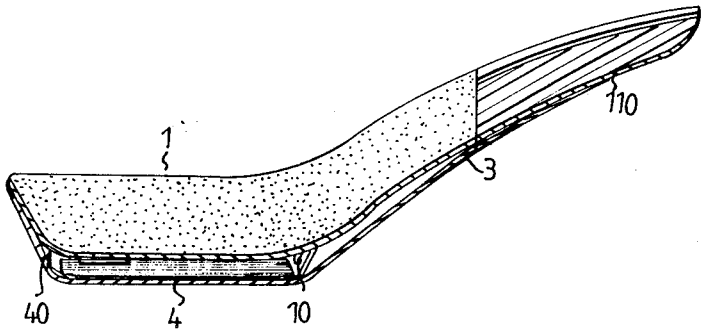
FIG. 7 is a sectional elevation of a spoon according to the present invention, in which a plastic bag the body of the spoon is wrapped up in a plastic bag which is secured to the handle of the spoon by a retainer ring.
Figure 6:
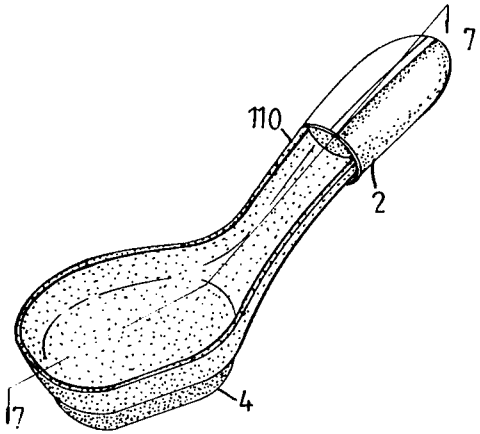

FIGS. 4 through 7 illustrate the use of the present invention. As illustrated in FIGS. 4 and 5, a plastic bag is drawn out of the bottom cap 4 and separated from the sheet of plastic bags 3 through an indentation line 30. The plastic bag thus obtained is sleeved on the body 1 with its open end bound up with the handle 11 permitting the film of the plastic bag to adhere to the surface of the oval-shaped body 1. The retainer ring 2 is then sleeved on the handle 11 to firmly secure the wrapped open end of the plastic bag to the handle 11 of the body 1 (see FIGS. 6 and 7).

I claim:

1. A spoon, including a small, shallow, oval-shaped body having an unitary handle obliquely extending upward therefrom, and comprising a retainer member on its bottom;

a bottom cap secured to said retainer member of said body and comprising a notch on its one side;

a sheet of plastic bags being received in said bottom cap, and comprised of a plurality of plastic bags each being respectively defined by a sealing line and an indentation line; and a retainer ring having an inner projection;

characterized in that a plastic bag can be drawn out of said bottom cap and separated from said sheet of plastic bags through respective indentation line, for wrapping up the spoon; said retainer ring can be sleeved on said handle to secure a plastic bag thereto; each plastic bag which is separated from said sheet of plastic bag to wrap up the spoon therein can be removed from the spoon each time after use, permitting a new plastic bag from said sheet of plastic bag to wrap up the spoon so that the spoon can be repeatedly used without the need to wash.

* * * * *